US007926547B2

(12) United States Patent
Poeppl et al.

(10) Patent No.: US 7,926,547 B2
(45) Date of Patent: Apr. 19, 2011

(54) STRAND GUIDING ROLLER

(75) Inventors: Johann Poeppl, Kirchschlag (AT); Guoxin Shan, Linz (AT); Heinrich Thoene, Linz (AT); Josef Watzinger, Reichenau (AT); Franz Wimmer, Riedau (AT)

(73) Assignee: Siemens Vai Metals Technologies GmbH & Co. (AT)

( * ) Notice: Subject to any disclaimer, the term of this patent is extended or adjusted under 35 U.S.C. 154(b) by 343 days.

(21) Appl. No.: 12/090,324

(22) PCT Filed: Oct. 2, 2006

(86) PCT No.: PCT/EP2006/009541

§ 371 (c)(1),
(2), (4) Date: Apr. 18, 2008

(87) PCT Pub. No.: WO2007/062713

PCT Pub. Date: Jun. 7, 2007

(65) Prior Publication Data

US 2008/0251229 A1 Oct. 16, 2008

(30) Foreign Application Priority Data

Oct. 20, 2005 (AT) ..... A 1717/2005

(51) Int. Cl.
*B22D 11/124* (2006.01)
*B22D 11/128* (2006.01)

(52) U.S. Cl. ..... 164/442; 164/448

(58) Field of Classification Search ..... 164/442, 164/448

See application file for complete search history.

(56) References Cited

U.S. PATENT DOCUMENTS

| | | | | |
|---|---|---|---|---|
| 4,010,528 | A * | 3/1977 | Bohmer | 492/1 |
| 4,071,073 | A * | 1/1978 | Bollig et al. | 164/448 |
| 4,164,252 | A * | 8/1979 | Scheurecker | 164/448 |
| 4,351,383 | A * | 9/1982 | Gladwin | 164/448 |
| 5,649,889 | A * | 7/1997 | Warner, III | 492/16 |
| 6,484,793 | B1 * | 11/2002 | Scheurecker | 164/448 |
| 7,325,586 | B2 | 2/2008 | Deibl et al. | |

FOREIGN PATENT DOCUMENTS

| | | | |
|---|---|---|---|
| AT | 412851 | B | 8/2005 |
| CN | 2522199 | | 11/2002 |
| DE | 24 23 224 | A1 * | 11/1975 |
| DE | 2423224 | A1 | 11/1975 |

(Continued)

OTHER PUBLICATIONS

International Search Report dated Jan. 17, 2007 issued in corresponding PCT Application No. PCT/EP2006/009541.

(Continued)

*Primary Examiner* — Kevin P Kerns
(74) *Attorney, Agent, or Firm* — Ostrolenk Faber LLP

(57) ABSTRACT

In the case of a strand guiding roller with at least one roller shell and with at least two supporting shafts, two supporting shafts being respectively connected in a rotationally fixed manner to a roller shell and each supporting shaft being rotatably supported in a supporting bearing, to achieve a type of construction that is simple and can withstand the high thermal and mechanical loading that occurs, it is proposed that the roller shell is connected in a rotationally fixed manner to the supporting shafts carrying it on both sides by shrink-fit connections or by press-fit connections.

8 Claims, 3 Drawing Sheets

FOREIGN PATENT DOCUMENTS

| | | | |
|---|---|---|---|
| DE | 2840902 | A1 | 3/1980 |
| DE | 3228190 | A1 | 9/1984 |
| DE | 20021514 | U1 | 4/2001 |
| EP | 0062920 | | 10/1982 |
| EP | 0543531 | A1 | 5/1993 |
| GB | 2032577 | | 5/1980 |
| SU | 1329899 | | 8/1987 |
| WO | WO 99/15305 | A1 | 4/1999 |
| WO | WO 02/02253 | A1 | 1/2002 |
| WO | WO 2005/016578 | A1 | 2/2005 |

OTHER PUBLICATIONS

Orlov, P.I. "Principles of Construction", A Reference and Instrumental Manual in Two Volumes, vol. 2, pp. 238 and 240, 1988.

* cited by examiner

STRAND GUIDING ROLLER

CROSS REFERENCE TO RELATED APPLICATION

The present application is a 35 U.S.C. §§371 national phase conversion of PCT/EP2006/009541, filed 2 Oct. 2006, which claims priority of Austrian Application No. A1717/05, filed 20 Oct. 2005. The PCT International Application was published in the German language.

BACKGROUND OF THE INVENTION

The invention relates to a strand guiding roller with at least one roller shell and with at least two supporting shafts, two supporting shafts being respectively connected in a rotationally fixed manner to a roller shell and each supporting shaft being rotatably supported in a supporting bearing.

A strand guiding roller of this type is already known from DE-A 24 23 224. In the case of this multi-part strand guiding roller, roller shells neighboring one another in the axial direction are connected by a supporting shaft which is rotatably supported in a journal bearing and engages with shaft stubs directed away from one another in axial recesses of the neighboring roller shells. A non-positive connection between the supporting shaft and the respective roller shell takes place by means of a screw connection between the two components and by interacting radial supporting surfaces on the supporting shaft and on the roller shell, whereby additional securement against release during operation of the plant is achieved. However, this design solution has not proven successful in practice, since this way of holding the components together does not withstand the rigours of metallurgical plant operation.

It is already known from WO 02/02253 A1 to form driver rollers in a strip casting plant from a roller shell and two supporting shafts, wherein the two supporting shafts, lying opposite one another, protrude into the roller shell and are screwed at their extreme ends to the roller shell (FIG. 6). The tightening screws are at the same time used as closure elements of the coolant lines.

A one-part strand guiding roller in which a roller shell is undetachably connected to two supporting shafts by a peripheral welded connection is known from DE-A 28 40 902. The roller shell is coated with an abrasion-resistant, non-corroding protective layer. Damage to individual components of a strand guiding roller usually result in their total loss and in high spare part costs.

The use of a weld for the connection of the roller shell and the supporting shaft is specifically not practicable for multi-part strand guiding rollers, since split bearings should necessarily be used for these. Such a centrally mounted strand guiding roller, in which a supporting shaft carrying a supporting bearing is connected to adjoining roller shells by welded connections is known from DE-A 32 28 190.

In the case of conventional peripherally cooled strand guiding rollers, as are already known for example from EP 0 543 531 A1 or AT 412 851 B, the coolant is conducted through coolant channels predominantly arranged radially or inclined in relation to the axis of rotation of the roller from the center of the roller to the periphery of the strand guiding roller, distributed there by way of ring lines, taken close to the surface of the roller shell through coolant channels aligned parallel to the roller axis and in an analogous way collected again and returned to the center. To make it easy to produce the coolant conducting system and the ring lines and seal them tightly with respect to the outside, sealing elements in the form of rings or plugs are usually screwed or welded to the end faces of the roller shell. Owing to the high thermal and material-related loads in the strand guiding roller, these sealing methods are complex, very sensitive and susceptible to faults.

It is also known in the case of strand guiding rollers with a continuous core shaft to fasten multi-layered roller shells in a rotationally fixed and detachable manner on the core shaft, for example by a feather key connection. The multi-layered structure of the roller shell is obtained by individual cylindrical sleeves, which are connected in a rotationally fixed manner by a full-area shrink-fit connection of the lateral surfaces of the cylinders lying opposite one another. The easy-to-produce coolant channels are located at the contact surfaces of the cylindrical sleeves (WO 2005/016578; WO 02/02253).

SUMMARY OF THE INVENTION

The present invention aims to avoid these difficulties and disadvantages and sets out to propose a strand guiding roller that comprises a number of easy-to-produce components which are connected to one another in such a way that the connection withstands the intensive thermal and mechanical loads during the casting operation, comprises components that are easy to produce and makes it possible for expensive components, such as preferably the roller shells and bearing housings, to be disassembled and possibly reused.

This object is achieved according to the invention by the roller shell being connected in a rotationally fixed manner to the supporting shafts carrying it on both sides by shrink-fit connections or by press-fit connections.

The intermediate supporting type of bearing takes place in principle on constrictions in the rollers, which takes place by means of the supporting shafts of smaller diameter shrink-fitted into the roller shells.

The shrink-fit or press-fit connection is designed such that stationary and non-stationary roller loads and drive torques occurring in the case of driven strand guiding rollers can be reliably transmitted and sealing functions for the coolant circulation are reliably ensured. The design of the shrink-fit or press-fit connection takes into account specific, operationally customary load cases, such as

- continuous strand take-off with rotating strand guiding rollers,
- stopped strand with stationary strand guiding rollers,
- roller cooling on the outside and on the inside,
- roller cooling only on the outside or only on the inside,
- total failure of the roller cooling caused by a fault.

Even in the worst case, that the shrink-fit or press-fit connection loses load-bearing capacity as result of thermal influence, adequate bending and rolling moment transmission and sealing function must still be ensured. In the case of strand guiding rollers with a roller diameter of 150 mm to 200 mm, this means a shrinkage oversize of 0.2 to 0.5 mm and, in the case of a greater roller diameter of 200 mm to 250 mm, a shrinkage oversize of 0.25 to 0.4 mm. As an approximate guide for fixing the length of the shrink fit, the ratio of the length of the shrink fit to the diameter of the shaft stub is greater than 1.

In comparison with perforated solid-body rollers, the shrink-fit connection results in lower notch stresses, thereby reducing the risk of rupture of the strand guiding roller. It is also possible to use material of higher strength for the lighter supporting shafts, allowing a very specific, and consequently economical, increase in strength to be achieved.

The described subassembly arrangement with shrink-fit or press-fit connection gives rise overall to the following advantages:

- The simple plug-in type of construction permits easy assembly of the long strand guiding rollers and low-cost production of the individual components.
- In the case of multi-part strand guiding rollers, no split intermediate supporting bearings are necessary.
- The particularly cost-effective production makes the strand guiding roller suitable as an inexpensive disposable roller.
- Alternatively, however, partial reuse of the strand guiding roller is also possible, specifically of the roller shell with the peripheral cooling system, and the bearing housings can also be reused. This is carried out by simple destructive disassembly, for example by a severing cut through the shaft stub of the supporting shaft.
- The sealing of the coolant passageways can take place largely without sensitive, synthetic sealing elements and without welds.

Each supporting shaft comprises at least one shaft stub, the outer lateral surface of which forms a shrink-fit connection or press-fit connection with an inner lateral-surface of a recess in a roller shell.

The basic structure of the components forming the shrink-fit or press-fit connection, both at the end regions of the strand guiding roller and in the regions between neighboring roller shells, is expediently the same. Accordingly, with a number of roller shells arranged in line in the axial direction, two neighboring roller shells are respectively connected in a rotationally fixed manner by a supporting shaft supported centrally by a supporting bearing.

The strand guiding rollers are equipped with internal cooling, two embodiments being particularly expedient:

According to one possible embodiment of the roller cooling, the roller shell is passed through by at least one coolant channel and this coolant channel is arranged at a constant distance from the cylindrical outer surface of the roller shell. In this case, the coolant channel forms, for example, a peripheral annular space. The roller shell is preferably passed through by a multiplicity of coolant channels, which are arranged at a constant distance from the cylindrical outer surface of the roller shell. The substantially radial feed and discharge lines for the cooling medium pass through the shrink-fit connection between the supporting shaft and the roller shell.

The feed and discharge lines may also be arranged inclined in relation to the axis of rotation of the strand guiding roller.

According to a refinement of the coolant circulating system that is simple in production engineering terms, arranged between the roller shell and the supporting shaft is a manifold sealing ring, which forms with the roller shell a coolant distributing line, into which the substantially radial feed or discharge lines and axially parallel coolant channels run out, and this manifold sealing ring forming with the roller shell and with the supporting shaft a rotationally fixed shrink-fit connection or a press-fit connection.

With this peripheral cooling, a long service life of the strand guiding roller is achieved as a result of the early removal of heat from the roller shell. Furthermore, the intensive roller shell cooling makes it possible for the continuous casting plant to be operated in a dry mode and allows continuous slabs, in particular thin continuous slabs, to be transported at higher temperature by the strand guidance of the continuous casting plant.

According to a further possible embodiment of the roller cooling, a coolant channel of a constant cross section and a central orientation in the axial direction passes through the alternately successive supporting shafts and roller shells. This axial cooling is particularly distinguished by its simplicity and inexpensive type of construction.

In the case of both embodiments of the roller cooling, the shrink-fit or press-fit connection means that there are no coolant leakages. It is possible to dispense with special seals within the strand guiding roller, since the sealing is produced by the shrink-fit connection.

In the case of a driven strand guiding roller, the described shrink-fit or press-fit connection can be used for the connection to the drive elements, in that a cardan shaft connection of a driven strand guiding roller is connected in a rotationally fixed manner to a supporting shaft supported centrally on a supporting bearing by a shrink-fit connection or by a press-fit connection.

The sealing of the coolant channels and coolant distributing lines by means of manifold sealing rings introduced into the roller shell by shrink-fit or press-fit connection obviate the need for sensitive independent sealing elements and welded connections.

In particular, the supporting bearings of the strand guiding roller that are formed as movable bearings are formed by rolling bearings, the rolling elements of which can compensate for operationally induced axial displacements and alignment deviations. Toroidal bearings, as are described for example also in the German utility model specification DE 200 21 514 U1, may be used for example for this purpose.

Further advantages and features of the present invention emerge from the following description of non-restrictive exemplary embodiments, reference being made to the accompanying figures, in which:

BRIEF DESCRIPTION OF THE DRAWINGS

FIG. 4 shows a partial section of the strand guiding roller with inclusion of a manifold sealing ring for passing the coolant through.

DESCRIPTION OF THE PREFERRED EMBODIMENT

The representations in the figures schematically show strand guiding rollers according to the invention, such as for example those suitable for use in a strand guide of a continuous casting plant for producing metal strands of great width with a cross section of slabs or thin slabs. Components that are the same or have the same effect in different embodiments are identified by the same designations.

Figure 1:
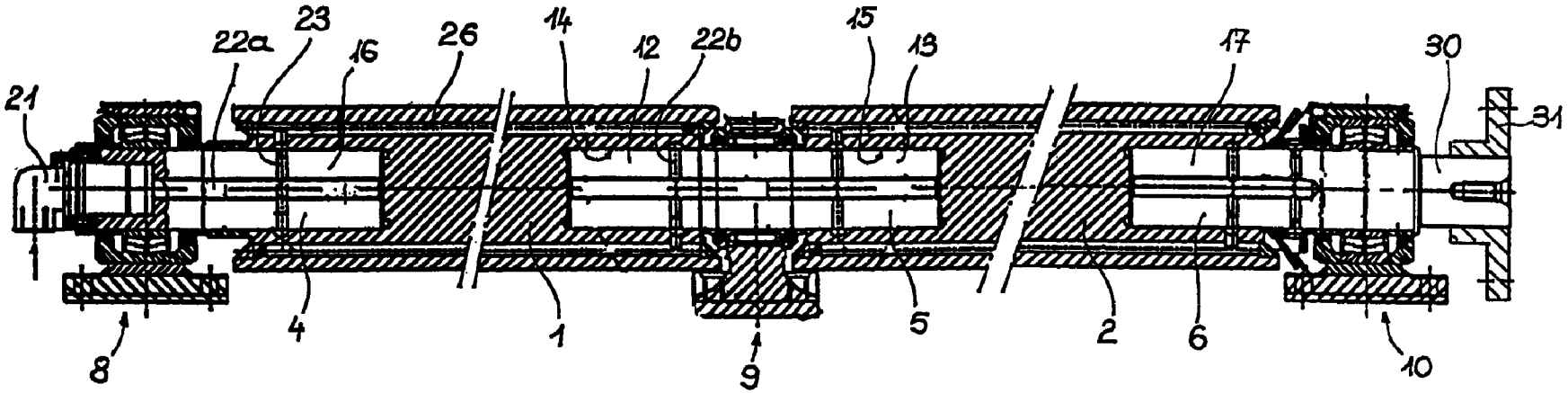
FIG. 1 shows a strand guiding roller according to the invention with two roller shells and peripheral roller shell cooling.

The non-driven, two-part strand guiding roller represented in a longitudinal section in FIG. 1 comprises two roller shells 1, 2 and three supporting shafts 4, 5, 6, the supporting shafts being rotatably supported in supporting bearings 8, 9, 10. As seen in FIG. 1, the bearings 8, 9, 10 comprise roller bearings with rolling elements which compensate for operationally inclined axially displacements and alignment deviations (CARB bearings). The supporting shaft 5 arranged between two roller shells 1, 2 ends in two shaft stubs 12, 13, which are directed away from one another in the axial direction and protrude into cylindrical recesses 14, 15 of the neighboring roller shells 1, 2. The non-positive connection between the shaft stud 12, 13 and the roller shell 1, 2 is produced by a shrink-fit connection or a press-fit connection, which takes into account the prevailing thermal and mechanical loads during the transportation of a steel strand through the strand guide. Two supporting shafts 4, 6 carrying the roller shells 1, 2 at the ends of the strand guiding roller respectively have only one shaft stub 16, 17, which stubs are fitted in recesses of the roller shells 1, 2, forming a shrink-fit or press-fit connection.

Figure 3:
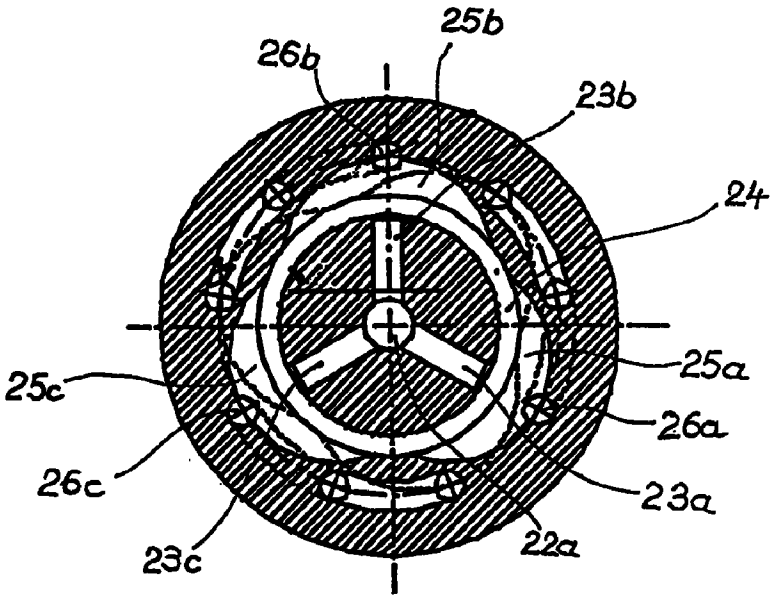
FIG. 3 shows a cross section through the strand guiding roller with a representation of the coolant feed along the sectional line A-A in FIG. 1.

The strand guiding roller is equipped with internal cooling, formed as peripheral cooling and represented in FIGS. 1 and 3. The introduction of coolant into the supporting shaft 4 takes place through a rotary lead-in 21 coupled onto the end. The supporting shaft 4 has a central coolant channel 22, 22*a*, from which a number of radial branch lines 23, 23*a*, 23*b*, 23*c* lead away from the region of the shaft stub 16 to the roller shell 1 and run out there in an annular space 24 with sickle-shaped widenings 25*a*, 25*b*, 25*c*. From these sickle-shaped widenings, coolant lines 26, 26*a*, 26*b*, 26*c* lead under the surface of the shell, at a small distance from it and distributed uniformly over the circumference of the roller shell 1, parallel to the axis of rotation of the strand guiding roller, with a repeated reversal in direction being provided. In the region of the shaft stub 12 of the supporting shaft 5, the coolant lines 26 run out again in sickle-shaped widenings of an annular space, from which radial branch lines lead to the central coolant channel 22*b* in the shaft stub 12 of the supporting shaft 5. In the region of the shaft stub 13, the passing through of the coolant is repeated for the roller shell 2 in a way analogous to the described way in which the coolant passes through in the roller shell 1. This arrangement is repeated furthermore according to the number of roller shells from which a multi-part strand guiding roller is formed. The central coolant channel runs out in a rotary transition lead-in, through which the coolant flowing through the strand guiding roller is led away again. The coolant lines are routed such that, in the region of the shrink-fit connection, they run from the supporting shaft into the roller shell and back, so that the tight shrink-fit connection acts at the same time as a seal against coolant leakages.

Figure 2:
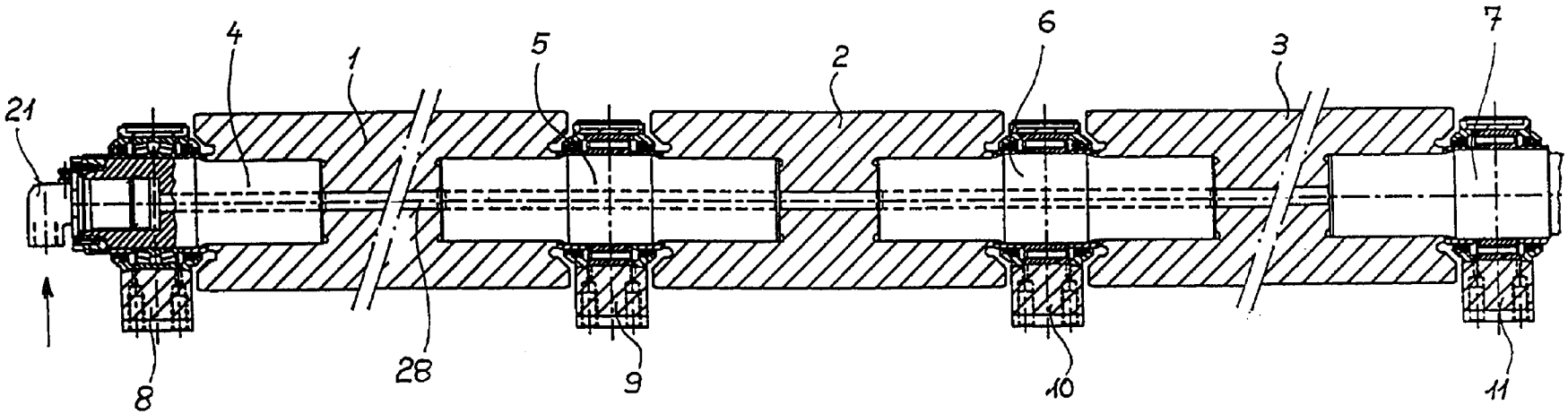
FIG. 2 shows a strand guiding roller according to the invention with three roller shells and central roller cooling.

FIG. 2 schematically represents a three-part strand guiding roller, which comprises three roller shells 1, 2, 3, supporting shafts 4, 5, 6, 7 carrying these roller shells and supporting bearings 8, 9, 10, 11 rotatably supporting the supporting shafts. As already described with respect to the strand guiding roller according to FIG. 1, the roller shells and the supporting shafts are non-positively connected by a shrink-fit or press-fit connection. The passing through of the coolant takes place through a central coolant channel 28, which passes in the axial direction through the successive supporting shafts and roller jackets. On the input side and on the output side of the coolant channel, rotary lead-throughs 21 for feeding in and leading away the coolant are provided, only the rotary lead-through for the feeding in of the coolant being represented. The shrink-fit connections between the roller shells and the supporting shafts seal the transitions of the central coolant channel between the roller shell and the supporting shafts against losses from leakage with respect to the outside.

FIG. 1 shows a multi-part driven strand guiding roller in which the outer supporting shaft 6 has two shaft stubs 17, 30. The shaft stub 17 is connected to the roller shell 2 by a shrink-fit connection and the shaft stub 30 protrudes into a connecting element 31 of a cardan drive shaft, which is likewise connected by a shrink-fit connection to the shaft stub 30.

Figure 4:
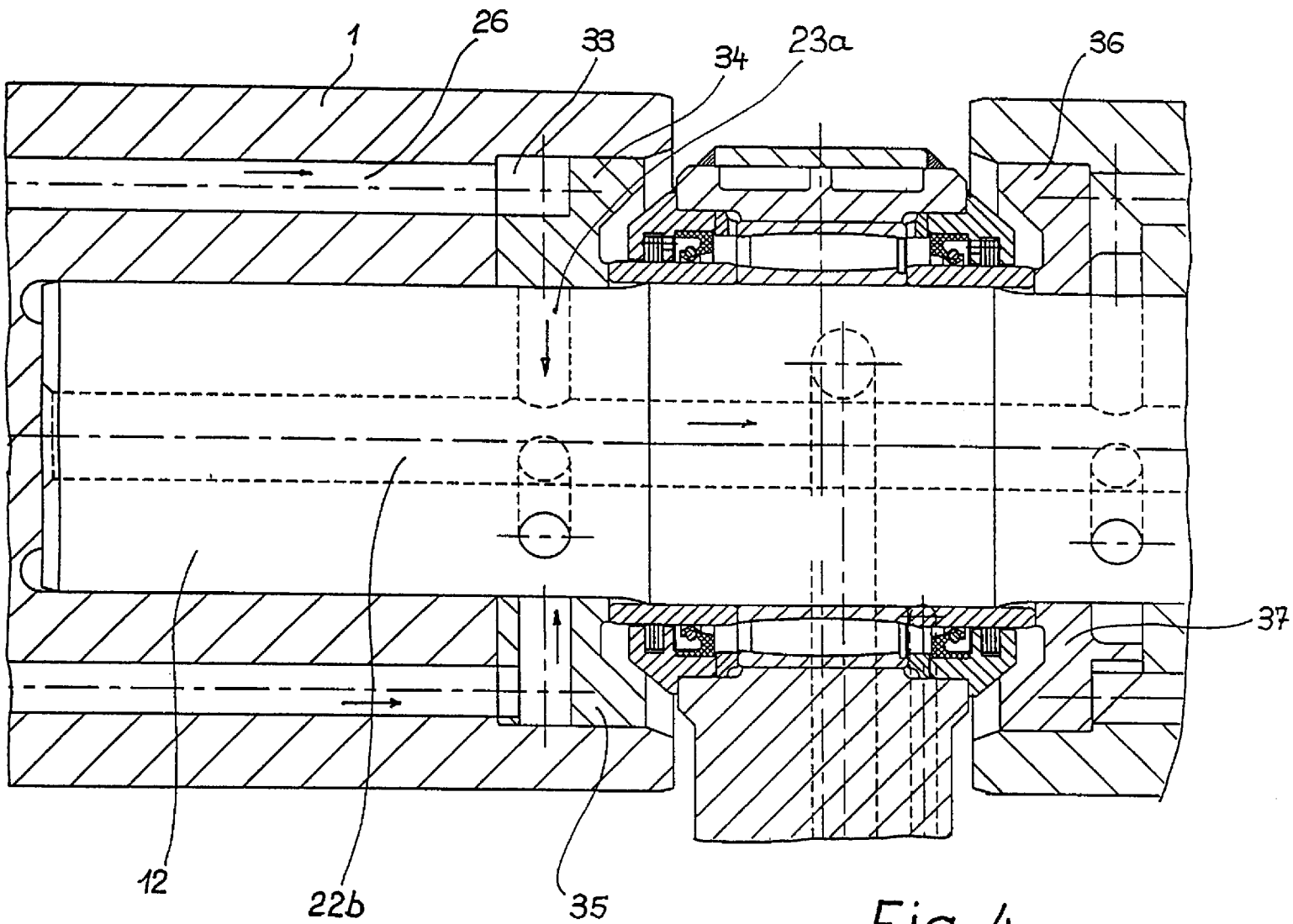

In FIG. 4, a further embodiment of a strand guiding roller with peripheral cooling is represented in a partial section and shows the coolant return from the coolant lines 26 passing through the roller shell 1 in the axial direction into the coolant channel 22*b* arranged centrally in the shaft stub 12. All the coolant lines 26, of a parallel orientation, run out into a coolant distributing line 33, which is formed by a peripheral ring line and the walls of which are formed by the roller shell 1 and a manifold sealing ring 34. Just a few radially aligned discharge lines 23*a* connect the ring lines 33 to the coolant channel 22*b*. In the same way, at a different location, the feeding in of the coolant takes place through coolant distributing lines arranged in an analogous way.

Altogether, FIG. 4 shows four possible design variants of the manifold sealing ring 34, 35, 36, 37.

The manifold sealing ring 34 is pressed into the roller jacket 1 and forms with it a rotationally fixed shrink-fit or press-fit connection. Equally, the manifold sealing ring 34 is shrink-fitted together with the roller shell 1 on the shaft stub 12.

The invention claimed is:

1. A strand guiding roller comprising:

at least one roller shell having opposite first and second ends, a respective shaft recess having an inner lateral surface in each end of the roller shell;

a respective supporting shaft connected in a rotationally fixed manner at each end of the roller shell, a supporting bearing rotatably supporting each supporting shaft; the roller shell being connected in a rotationally fixed manner to the respective supporting shafts carrying the roller shell on both ends by shrink-fit connections or by press-fit connections; each supporting shaft comprising at least one shaft stub having an outer lateral surface which forms a shrink-fit connection or a press-fit connection with the inner lateral surface of the recess in a roller shell, the shrink-fit connection or press-fit connection producing a seal, wherein the shrink-fit connection or press-fit connection has a length of shrink fit for which the ratio of the length of the shrink fit to the diameter of the shaft is greater than 1, and further comprising the roller shell having a cylindrical outer surface;

at least one coolant channel passing through the roller shell and the at least one coolant channel is arranged radially inward from the cylindrical outer surface of the roller shell;

and substantially radial feed and discharge lines for a cooling medium pass through the shrink-fit connection between the supporting shaft and the roller shell.

2. The strand guiding roller as claimed in claim 1, comprising a plurality of the roller shells arranged in a line in an axial direction, two neighboring ones of the roller shells are respectively connected in a rotationally fixed manner by a respective one of the supporting shafts, and the one supporting shaft is supported centrally by a respective one of the supporting bearings.

3. The strand guiding roller as claimed in claim 2, wherein a coolant channel passes through the successive supporting shafts and roller shells which alternate in the axial direction.

4. The strand guiding roller as claimed in claim 3, wherein the coolant channel is of a constant cross section and has a central orientation in the axial direction of the roller.

5. The strand guiding roller as claimed in claim 1, further comprising a manifold sealing ring arranged between the roller shell and the supporting shaft, the shaft forms with the roller shell a coolant distributing line, into which the substantially radial feed or discharge lines and the axially parallel coolant channels run out, and the manifold sealing ring forming with the roller shell and with the supporting shaft a rotationally fixed shrink-fit connection or a press-fit connection.

6. The strand guiding roller as claimed in claim 1, further comprising a cardan shaft connection of a driven strand guiding roller having a connecting element connected in a rotationally fixed manner to a respective supporting shaft supported centrally on a supporting bearing by a shrink-fit connection or by a press-fit connection.

7. The strand guiding roller as claimed in claim 1, wherein the supporting bearings are movable bearings comprising rolling bearings having rolling elements which compensate for operationally induced axial displacements and alignment deviations (CARB bearings).

8. The strand guiding roller as claimed in claim 1, wherein the at least one coolant channel is arranged at a constant distance in from the cylindrical outer surface of the roller shell.

* * * * *